United States Patent [19]

Richards et al.

[11] Patent Number: 4,869,049

[45] Date of Patent: Sep. 26, 1989

[54] APPARATUS AND METHODS FOR USING PACKS OF FLEXIBLE TUBING IN PACKAGING

[75] Inventors: David C. Richards, Wokingham; Maurice S. Williams, Cranleigh; Brian Ward, Blackwater, all of United Kingdom

[73] Assignee: Process Improvements Limited, Glendale Park, United Kingdom

[21] Appl. No.: 159,173

[22] Filed: Feb. 23, 1988

[30] Foreign Application Priority Data

Mar. 5, 1987 [GB] United Kingdom ..... 8705120

[51] Int. Cl.[4] ..... B65B 1/04; B65B 7/12; B65B 9/12

[52] U.S. Cl. ..... 53/459; 53/370; 53/469; 53/483; 53/567; 53/576

[58] Field of Search ..... 17/49; 53/370, 451, 53/456, 459, 469, 483, 567, 576, 577

[56] References Cited

U.S. PATENT DOCUMENTS

| | | | |
|---|---|---|---|
| 3,321,103 | 5/1967 | Phillips | 220/63 |
| 3,452,368 | 7/1969 | Couper | 4/484 |
| 3,555,775 | 1/1971 | McMillan | 53/576 |
| 3,726,060 | 4/1973 | McMillan | 53/576 X |
| 3,940,906 | 3/1976 | Leckband et al. | 53/576 X |
| 4,021,885 | 5/1977 | Muller | 17/49 X |
| 4,518,507 | 5/1985 | Conner | 53/576 X |
| 4,545,091 | 10/1985 | Nausedas et al. | 17/49 |
| 4,624,030 | 11/1986 | Dreisin | 17/49 X |

FOREIGN PATENT DOCUMENTS

| | | |
|---|---|---|
| 857194 | 11/1977 | Belgium . |
| 2169188 | 7/1986 | United Kingdom . |

*Primary Examiner*—Robert L. Spruill
*Assistant Examiner*—Beth Bianca
*Attorney, Agent, or Firm*—Shoemaker and Mattare, Ltd.

[57] ABSTRACT

A pack comprising a core and pleated tubing is used to provide a series of packages each containing a disposable object such as a baby's nappy along the tubing as it passes over the top edges of the core and then down through the core. The core is turned by means of a lid about a cylinder to twist the flexible material at locations between the adjacent packs to seal the packs at their ends thereby providing hygienic disposal of the waste. A safely located rotatable cutter in the lid is provided for severing the flexible tubing above the top twist.

21 Claims, 5 Drawing Sheets

APPARATUS AND METHODS FOR USING PACKS OF FLEXIBLE TUBING IN PACKAGING

FIELD OF THE INVENTION

This invention relates to apparatus and methods for using packs of flexible tubing in packaging and in particular to packaging a series of objects respectively in individual packages along a length of such flexible tubing.

The invention is particularly applicable to the disposal of waste material although it is by no means exclusively applicable to that function.

A main object of the invention is to provide for the ready disposal of babies' disposable nappies. There is an extremely large market for these disposable nappies and mothers enjoy the convenience of using them but they all face the inevitable inconvenience of disposing of them afterwards and they have been left to find their own solutions to the problems of hygienic and smell-free disposal. There is obviously a need to improve the hygiene, convenience and economy of these objects and to improve the suppression of, or if possible, completely eliminate the smell.

DESCRIPTION OF THE PRIOR ART

European patent application No. 0005660 describes a piece of kitchen furniture whereby kitchen refuse can be disposed in packages enclosed by flexible tubing derived from a tubular pack of tubing surrounding a tubular guide. The tubing passes from the pack over the top of and then down the guide to a position beneath the guide where it has been closed by fusion to provide a receptacle within the guide means. When this receptacle is full of refuse, a lever is manually operated to actuate an electro-mechanical apparatus including clamping and fusion devices that travel round closed tracks to perform the four-fold task of drawing the receptacle down below the tubular guide, fusing the tubing walls together to seal the top of the receptacle, sealing the tubing walls together to provide the closed base of the next receptacle and dividing the tubing by heat at a location between these two fusion locations to separate the filled package.

Obviously it is essential to avoid the presence of electricity anywhere where there may be babies present and where there can be moisture. Clearly also complicated mechanical devices are to be avoided where reliability and economy are essential.

SUMMARY OF THE INVENTION

A principal object of the invention therefore, is to provide a safe and comparatively simple portable apparatus that is quick and easy to operate, that stores soiled nappies in flexible tubing from a pack thereof very hygienically for more than a day if required, and then allows them to be disposed of in a closed container. The apparatus is then reused until it has fully used its pack of simple and cheap packaging material when it can be recharged with another pack.

According to the present invention, apparatus for packaging a series of objects respectively in individual packages distributed along a length of flexible, substantially non-resilient tubing providing the walls of the packages comprises tubular guide means arranged to receive a substantially vertical pack of said flexible tubing when formed into a gathered tube and to enable one end of the tubing in the gathered pack to be drawn away from the top of the gathered pack and passed over the top of the tubular guide means when surrounded by the gathered pack and then coaxially downwards through the tubular guide means so that the outer surface of the flexible material in the pack becomes the cylindrical inner surface of the flexible material passing through the tubular guide means, the top end of the flexible tubing being initially open until sealed to form the base of a first package having the flexible tubing as its side wall, the apparatus being arranged for the base to be thrust downwards as by an object to be packaged, while further flexible tubing is drawn from the pack over the top of the tubular guide means into the tubular guide means providing space for an object to be packaged when located in or below the tubular guide means, and means above the tubular guide means for manually twisting the flexible tubing above an object when so located to close and thereby complete a package comprising that object and so provide the base for a further package for a further object to be thrust into the tubular guide means.

According to another aspect of the invention, a method of packaging a series of objects respectively in individual packages distributed along a length of flexible, substantially non-resilient tubing providing the walls of the packages comprises arranging a substantially vertical pack of said flexible tubing, when formed into a gathered cylinder, around tubular guide means, drawing one end of the tubing in the gathered pack from the top of the pack, closing said end to provide the base of a first package having the flexible tubing as its side wall, thrusting an object to be packaged against said base to push the base downwards thereby drawing further flexible tubing from the pack over the top of the tubular guide means until the object has been located in or below the tubular guide means, and manually operating twisting means to twist the flexible tubing above the object when so located to close and thereby complete a package comprising the object and so provide the base for a further package for a further object to be thrust into the tubular guide means.

The invention may be employed for various forms of waste, besides babies' disposable napkins. For example, the invention may be used in a hospital or for a dustbin. In this specification the items deposited in the packages will be referred to, except where otherwise indicated, as objects, whether they are single objects or discrete collections of items or even liquids.

DESCRIPTION OF THE DRAWINGS

In order that the invention may be clearly understood and readily carried into effect apparatus and methods in accordance therewith will now be described, by way of example, with reference to the accompanying drawings, in which.

DESCRIPTION OF A PREFERRED EMBODIMENT

Figure 3:
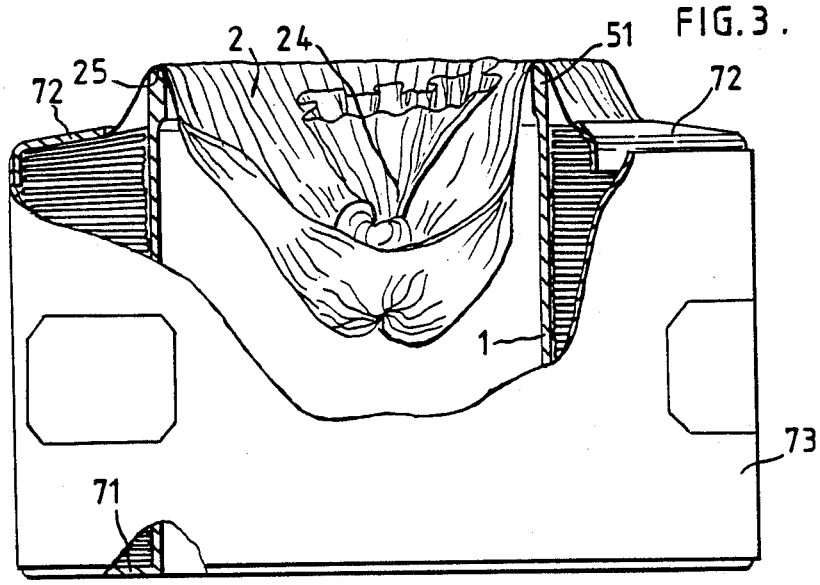
FIG. 3 is a side elevation, partly in section, showing portions of the apparatus of FIGS. 1 and 2 when separated from one another.

Referring to FIGS. 1 to 5, a plastics container 21 is formed with an internal flange 22 from which a cylinder 23 extends upwards. A pack consisting of a tubular core 1 inside a profusely circumferentially pleated length of flexible tubing 2 is located in the container 21 with the core 1 resting on the flange 22 and rotatable on the cylinder 23. To begin using the pack to form a series of packages of objects, which in this particular example will be considered to be a baby's disposable nappies, the top of the flexible tubing 2 is pulled upwards and tied into a knot 24 (FIG. 3). This closed end can then form the bottom of a package to be formed along the length of part of the tubing. This is effected by pushing the closed end downwards inside the core 1 and cylinder 23 by the object to be packaged. As this is being done the flexible tubing 2 from the pleated length slides over the top edge 25 (FIGS. 1 and 3) of the core 1 which is made sufficiently smooth to prevent the flexible tubing from being damaged. The core 1 may be approximately four inches (10.16 cm) in diameter but, of course, the diameter of the flexible tubing 2 is substantially more than this.

Figure 1:
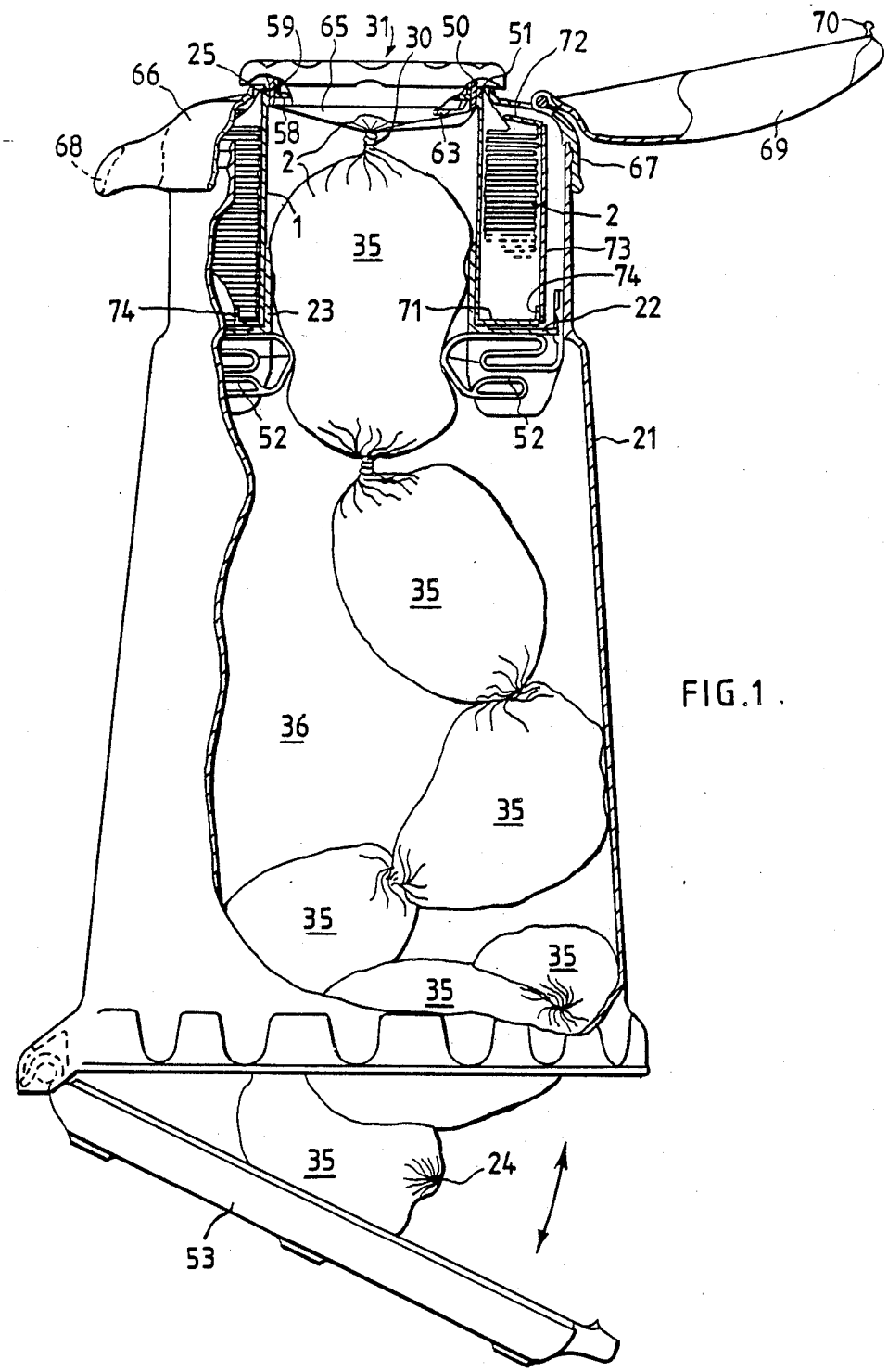
FIG. 1 is a side elevation, mostly in section, of apparatus for packaging a series of objects respectively in individual packages distributed along a length of flexible tubing.
Figure 2:
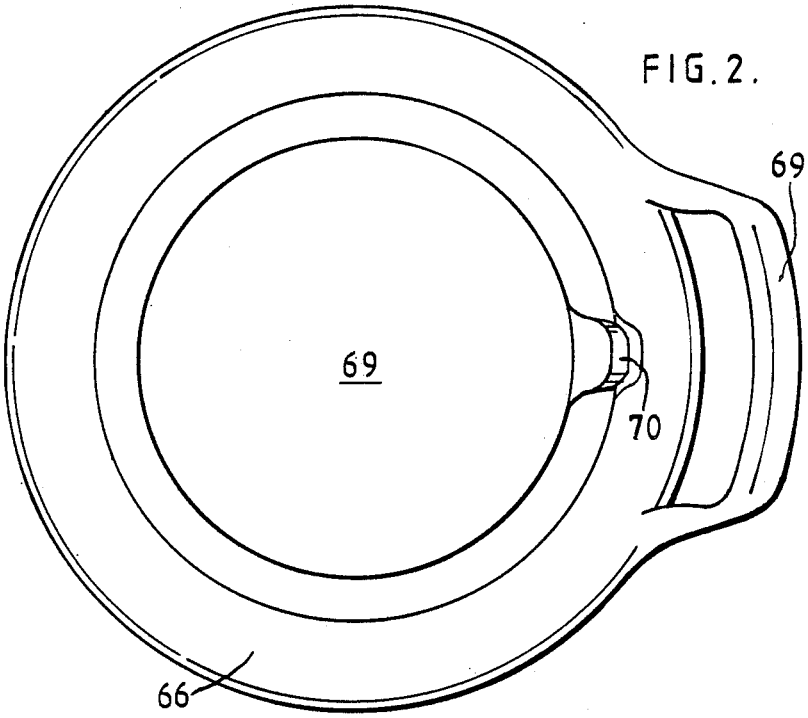
FIG. 2 is a plan of the apparatus of FIG. 1.

When the object has been thrust well down into the concentric core 1 and cylinder 23, the package is closed by twisting the flexible tubing 2 above the object as at 30 (FIG. 1). This is done by turning the core 1 with remaining pleated tubing thereon about the core axis. A lid 31 is formed for this purpose in that it has a depending annular flange 50 formed with an outer surface that is a taper fit in a frusto-conical inner surface 51 at the top of the core 1. The package is prevented from turning about the axis of the core during this manual twisting action by springs 52 fixed to the container 21 and projecting radially inwards to engage the package. These springs are equidistantly spaced round the container 21. Shallow, grooves dividing upwardly extending ridges are formed on the frusto-conical inner surface 51 to stop slippage of the flexible tubing during the twisting operation.

By the aforesaid means, a series of connected closed packages 35 are formed and this can be continued until the pleated tubing 2 is exhausted. In the arrangement of FIG. 1 the packages collect in a bin portion 36 of the container closed at the bottom by a hinged base 53 normally held closed by a manually operable catch 54. When it is desired to remove the packages from the bin portion 36 for transport to a waste disposal facility, the uppermost package is severed by means described below above its upper twisted closure 30 and the hinged base 53 opened for the removal of the packages through the end of the bin portion. Even if the twisted seals between the packages become loosened, the lid and the newly formed topmost twisted seal will prevent the escape of odours, vapours and gases to the ambient atmosphere. However, it has been found that when the tubing 2 is made of high density polyethylene the twisted joints remain remarkably tight.

Figure 6:
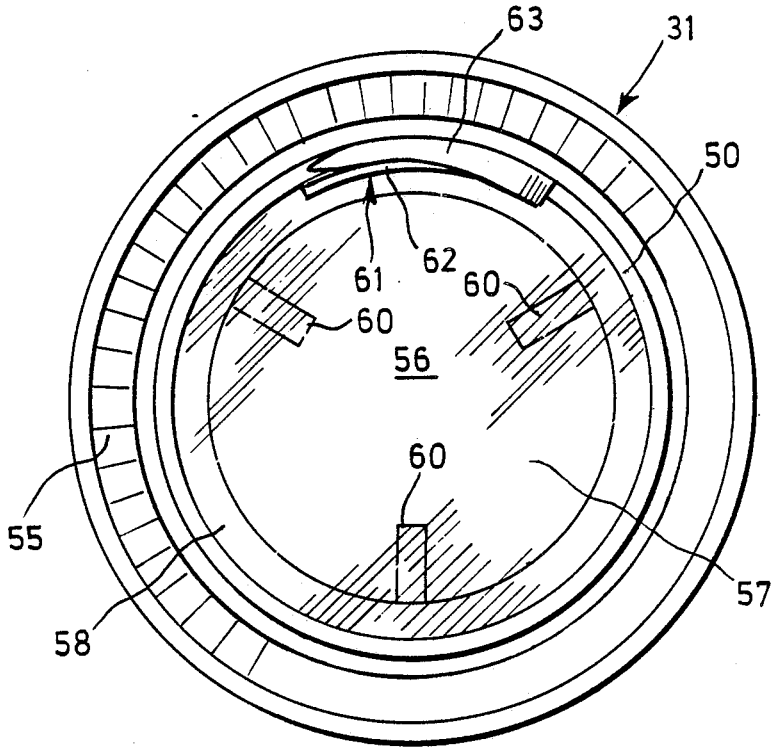
FIG. 6 is a plan, shown from beneath, of a detail of the apparatus of FIGS. 1 to 5.

The aforesaid severing means is incorporated in the lid 31 which is a bipartite unit comprising an outer ring 55 formed with the flange 50 that locks into the top of the core 1 and a disc 56 (FIG. 6 which is an underneath plan) which is freely rotatable in the ring 55. The disc 56 comprises a circular transparent sheet 57, through which the user can see the twisted flexible tubing, set in an angle section ring having a horizontal flange 58 and a vertical flange 59 (FIG. 1) located between narrow flanges inside the relatively stationary flange 50. In the angle of the ring 58, 59 three finger pieces 60 are fixed 120° apart above the transparent sheet 57. A cutter unit 61 is fixed beneath the flange 58. This device has an upper arcuate part 62 and a lower tapered shoe 63 with a gap between them along the major portion of their length. Close to the closed termination of this gap a metal cutter blade 64 is fixed as close as possible to the relatively stationary flange 50 so that the blade is shrouded against doing any damage to a person's fingers when the lid 31 is removed. The predominant material for the lid may be plastics material or metal.

To operate the cutter unit 61, the disc 56 is turned by means of the finger pieces 60 through a full revolution. In this movement the tapered shoe 63 pierces through the radially pleated taut portion 65 of the flexible tubing that flares outwards from the topmost twist 30 to the core 1. Further rotation of the disc 56 causes the cutter blade 64 to cut round the tubing material, cleanly separating the uppermost package from the flexible tubing remaining on the core 1.

A see-through cover 66 made from plastics moulded material is screwed onto the top of the container 21 by means of coarse threads 67. This has a handle 68 enabling the apparatus to be carried about, and hinged lid 69 which is held closed by a latch 70 arranged to be difficult for a toddler to operate and open the cover to start playing with the lid 31.

When the flexible tubing has all been used, the lid 31 is removed, the core 1 withdrawn and a refill pack as shown in FIG. 3 inserted. The core 1 is a rigid plastics moulding with a flange 71 at the bottom that supports the pleated length of flexible tubing 2 that is 75 feet (22.875 m) long, enough to accommodate approximately 108 disposable nappies in separate packages. An angle-section plastics ring 72 is supported above the pleated tubing. This provides sufficient clearance with the core 1 to enable the tubing to be drawn upwards from the pack. A flexible, transparent, plastics sleeve 73 surrounds the pack and is secured to an upturned flange 74 on the flange 71 and to the ring 72 by sticky tape (not shown).

Figure 4:
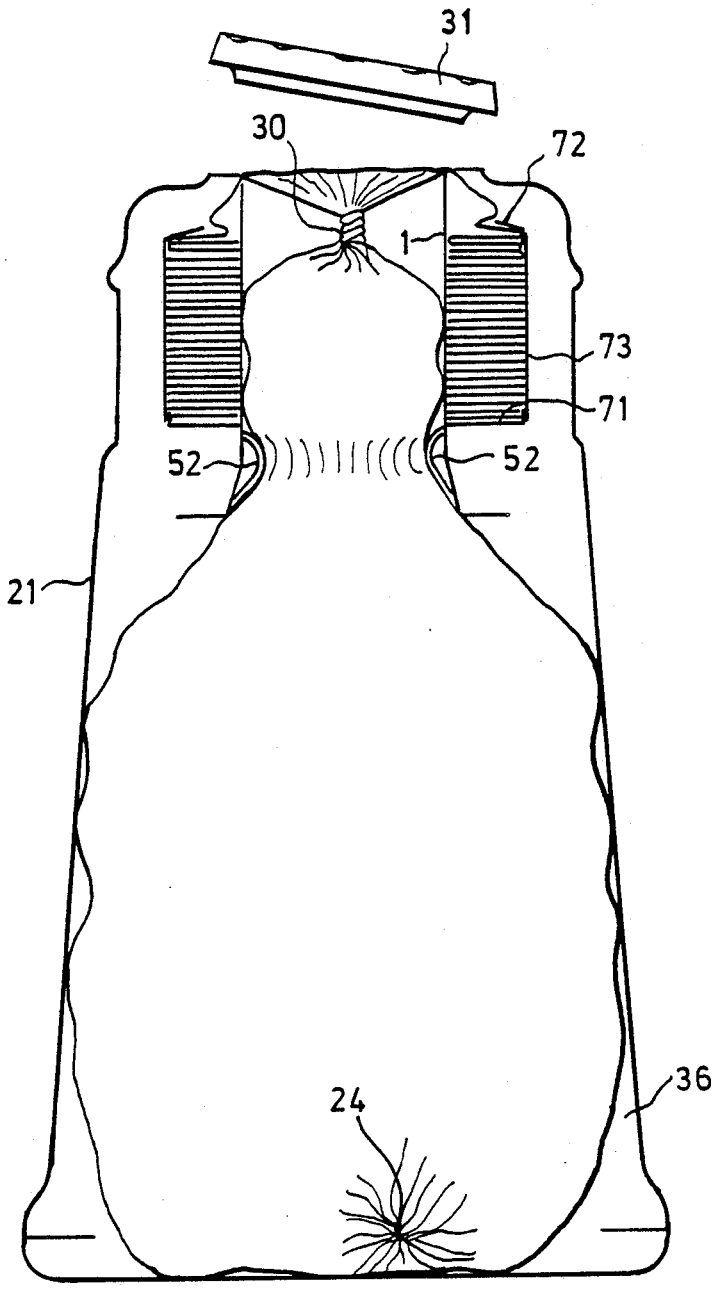
FIGS. 4 and 5 are diagrams showing alternative ways in which the apparatus of FIGS. 1 to 3 can be used.

FIG. 4 shows how the apparatus can be used to produce a single large package substantially filling the bin portion 36 of the container 21. The tied end 24 of the flexible tubing is pushed down to the bottom of the bin portion 36 as the tubing is filled and when the package is full enough to be gripped by the springs 52 it is sealed by twisting the tubing at 30 by means of the lid 31. This package can hold approximately 310 disposable nappies using the pack described above.

Figure 5:
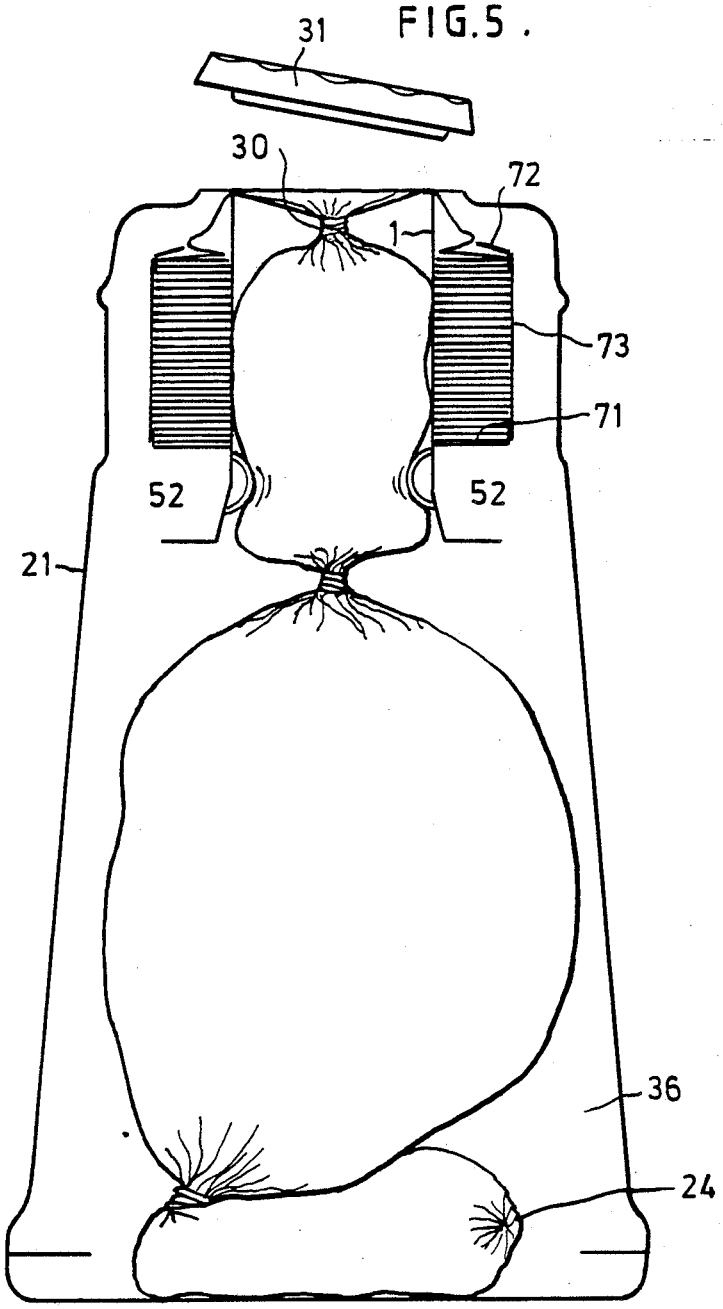

FIG. 5 shows a method which is intermediate between those described above with reference to FIGS. 1 and 4 respectively, packages of different sizes being produced according to the positions of the points at which it is considered desirable to twist the top of a topmost package to prevent the escape of odours, vapours or gas.

It will be understood that various modifications may be made to the example particularly described above without departing from the scope of the following claims. For example, a sleeve can be rotatably mounted on the cylinder 23 for the pack to be fitted tightly thereon, the sleeve being extended upwards to present the frustoconical inner surface 51 for turning the pack about its axis to twist the flexible tubing. For example, also the bin portion 36 may be made detachable from the portion of the container containing the pack and associated parts. Yet again, a cutter for severing the topmost package from the remainder of the flexible tubing can be provided beneath the pack location. The various objects described above as cylinder, core, casing and sleeve do not have to be solid tubes but can be perforate or openwork elements.

We claim:

1. Apparatus for packaging a series of objects respectively in individual packages distributed along a length of flexible, non-resilient tubing providing walls of the packages, the apparatus incorporating tubular guide means formed to present a peripheral edge at one end and arranged to receive a pack of said tubing when formed into a gathered tube surrounding said tubular guide means and to enable an end of said gathered tubing to be drawn from said pack, closed to form the base of a package and then passed over said peripheral edge to extend in the reverse direction through said tubular guide means;

the apparatus being characterized by the provision of a stationary support formed to support said tubular guide means and also formed with an opening located for the passage therethrough, in a direction away from said peripheral edge, of a closed package after formation thereof within said tubular guide means and consisting of an object contained in said flexible tubing, said tubular guide means and said support being arranged for said base to be thrust in a direction towards said opening as by an object to be packaged when passed through said peripheral edge to provide a space in said flexible tubing for such object while causing further tubing to be drawn from said pack over said edge, and manually rotatable means mounted for rotation with respect to said support adjacent said edge of said tubular guide means for engaging said tubing on the side remote from said opening of an object being packaged and for twisting said tubing to complete a package and thereby provide a base if required for a further package for a further object to be inserted within said tubular guide means.

2. Apparatus according to claim 1, in which said stationary support and said tubular guide means are arranged to receive a pack of said tubing when consisting of a pleated cylinder of flexible tubing formed with circumferential pleats and mounted on a cylindrical core which at least in part constitutes said tubular guide means.

3. Apparatus according to claim 2, in which said support is formed with an axially projecting cylinder surrounding said opening and arranged for said core to be rotatable thereon, and said rotatable means are formed to be secured in relation to said core to enable said core to be rotated thereby on said projecting cylinder for twisting said tubing, and the apparatus further comprises at least one element fixed in relation to said support for inhibiting a package against axial rotation during said twisting of said tubing.

4. Apparatus according to claim 2, comprising a manually rotatable cutter mounted adjacent the said edge of said tubular guide means for severing said tubing after it has been twisted to close a package, thereby to detach that package from any further packages.

5. Apparatus according to claim 2, comprising a manually rotatable cutter incorporated in said rotatable means and rotatable relatively thereto, said cutter being positioned for severing said tubing after it has been twisted to close a package, thereby to detach that package and any further and lower such packages formed with said tubing.

6. Apparatus according to claim 5, in which said rotatable means comprises an outer ring arranged to be detachably attached to said core and said rotatable cutter comprises a coaxial disc mounted to be manually rotatable in said ring and a shrouded blade unit fixed to said disc and formed so as first to pierce the material of said tubing and then sever said tubing peripherally on rotation of said disc.

7. Apparatus according to claim 6, in which said shrouded blade unit comprises a cutter blade and a two-armed member having an outer arm fixed along the surface of said disc and an inner arm shaped to pierce the material of said tubing, said blade being fixed to present a cutting edge between said two arms.

8. Apparatus according to claim 6, in which said disc is formed at its centre of transparent material of an area sufficient to enable the tubing to be observed.

9. Apparatus according to claim 6, in which said ring is formed with an annular flange shaped with a taper for locking with respect to said peripheral edge of said core.

10. A method of packaging a series of objects respectively in individual packages distributed along a length of flexible, substantially non-resilient tubing, the method comprising the step of arranging a pack of said tubing, when formed into a gathered cylinder, around tubular guide means, drawing one end of said tubing in said gathered pack from an end of said pack, closing said end of said tubing to provide the base of a first package having said tubing as its side wall, thrusting an object to be packaged against said base to push said base into said tubular guide means thereby drawing further tubing in a reverse direction from said pack over an edge of said tubular guide means until said object has been located beyond said edge of said tubular guide means;

said method being characterized by twisting said tubing adjacent said edge of said tubular guide means by manually operating twisting means to complete a package comprising the object while holding the package being completed against axial rotation and so provide the base for a further package for a further object to be thrust into said tubular guide means.

11. A method according to claim 10, in which said gathered cylindrical pack is arranged as a pleated cylinder of tubing formed with circumferential pleats mounted on a cylindrical core at least in part constituting said tubular guide means.

12. A method according to claim 10, in which said flexible tubing used is high density polyethylene tubing.

13. A method according to claim 10, in which the objects being packaged are a baby's disposable nappies.

14. A method according to claim 11, in which said manual twisting of said tubing is effected by means of a cap detachably mounted on said core.

15. A method according to claim 11, including operating a rotatable cutter to sever said tubing beyond the twisted portion thereof after completion of said package so as to detach said package from remaining tubing.

16. A portable waste-receiving receptacle having means for forming separable, disposable packages therein, comprising:

a housing having first and second ends and defining a container therebetween; means on said one end defining an opening through which objects to be packaged are placed;

guide means surrounding said opening and having means for rotatably supporting a supply of flexible tubing arranged in a gathered pack so that an end of said tubing may be grasped, pulled from said pack, closed and then pushed through said opening to define a tubular sleeve within said receptacle and having an open end and a closed end, whereby objects may be inserted through said opening and into said sleeve to form a package;

means on said receptacle for holding said package against rotation;

rotatable means on said first end of said receptacle for rotating said pack of tubing and that portion of tubing leading therefrom to the package containing the objects to thereby twist the tubing and close off that portion of the tubing containing the objects, forming a discrete package; and means for severing said tubing between the twisted portion and the pack of gathered tubing to separate the package from the remainder of the tubing, thereby forming a separate package for disposal.

17. A portable receptacle for receiving waste material, such as used disposable diapers, and sealing same in closed packages for disposal, comprising:

a housing having a first end and a second end and defining a container therebetween, said first end having an opening therethrough leading to the interior of the container;

annular support means on the first end for rotatably supporting a supply of flexible tubing arranged in a gathered annular pack so that an end of said tubing may be grasped, pulled from the pack, closed and pushed through the annular support means, thus inverting the tubing to form a flexible tubular sleeve having a closed end within the container, whereby an object such as a used disposable diaper may be placed in the tubular sleeve;

means in the container for engaging and holding the sleeve and object contained therein against rotation relative to the container;

rotatable means on said first end for engaging and rotating said pack and flexible tubing relative to the container and to the sleeve and object contained therein, whereby said tubing is twisted to close the tubing and seal the object within the sleeve, forming a discrete package; and means for severing the tubing between the twisted portion and the pack to form a separate, sealed package for disposal.

18. A receptacle as claimed in claim 17, wherein:

the rotatable means comprises a removable cap which is rotatable on said first end of the receptacle, said cap having means engaging the tubing to rotate it when the cap is rotated.

19. A receptacle as claimed in claim 17, wherein:

the supply of flexible tubing is removable and replaceable from the support means for providing a fresh supply of tubing when the supply held on the support means is exhausted.

20. A receptacle as claimed in claim 18, wherein:

said cap has an end wall and closes the opening formed through said first end of the receptacle when the cap is in place on the receptacle.

21. A receptacle as claimed in claim 20, wherein:

said second end of said receptacle has an openable closure thereon to permit removal of packages comprising said severed tubing and objects enclosed therein.

* * * * *